US008810337B2

(12) United States Patent
Nusair

(10) Patent No.: US 8,810,337 B2
(45) Date of Patent: Aug. 19, 2014

(54) COMPACT BANDPASS FILTER WITH NO THIRD ORDER RESPONSE

(75) Inventor: Marwan E. Nusair, Cincinnati, OH (US)

(73) Assignee: Valentine Research, Inc., Cincinnati, OH (US)

( * ) Notice: Subject to any disclaimer, the term of this patent is extended or adjusted under 35 U.S.C. 154(b) by 504 days.

(21) Appl. No.: 12/983,361

(22) Filed: Jan. 3, 2011

(65) Prior Publication Data

US 2012/0169437 A1 Jul. 5, 2012

(51) Int. Cl.
*H01P 1/203* (2006.01)
*H01P 7/08* (2006.01)

(52) U.S. Cl.
CPC ..... *H01P 1/20363* (2013.01); *H01P 7/082* (2013.01)
USPC ..... 333/204; 333/219

(58) Field of Classification Search
CPC . H01P 1/203; H01P 1/20354; H01P 1/20363; H01P 7/082
USPC ..... 333/204, 205, 219, 235
See application file for complete search history.

(56) References Cited

U.S. PATENT DOCUMENTS

| | | | | | |
|---|---|---|---|---|---|
| 4,288,766 | A | * | 9/1981 | Okita | 333/204 |
| 4,489,292 | A | * | 12/1984 | Ogawa | 333/202 |
| 4,513,263 | A | | 4/1985 | Minnis | |
| 5,023,866 | A | | 6/1991 | De Muro | |
| 5,192,927 | A | | 3/1993 | Lin | |
| 5,291,161 | A | * | 3/1994 | Saka | 333/204 |
| 5,334,961 | A | | 8/1994 | Shirai et al. | |
| 5,461,352 | A | | 10/1995 | Noguchi et al. | |
| 5,742,215 | A | | 4/1998 | Park | |
| 6,127,962 | A | | 10/2000 | Martinson | |
| 7,057,481 | B2 | | 6/2006 | Yeh | |
| 7,652,548 | B2 | * | 1/2010 | Yoshikawa et al. | 333/204 |

OTHER PUBLICATIONS

Wen-Hua Tu et al.; Compact Microstrip Bandstop Filter Using Open Stub and Spurline; IEEE Microwave and Wireless Components Letters; vol. 15, No. 4; Apr. 2005.

Karthikeyan, S.S. et al.; Harmonic Suppression of Parallel Coupled Microstrip Line Bandpass Filter Using CSRR; Progress in Electromagnetics Research Letters; vol. 7; pp. 193-201; 2009.

* cited by examiner

*Primary Examiner* — Benny Lee
*Assistant Examiner* — Gerald Stevens
(74) *Attorney, Agent, or Firm* — Stevens & Showalter, LLP

(57) ABSTRACT

A bandpass filter passes a range of frequencies with low loss while suppressing frequencies above and below the passed range of frequencies. One or more spurlines is included into the existing structure of the bandpass filter so that a selected odd multiple of the passed frequency range is suppressed.

3 Claims, 3 Drawing Sheets

COMPACT BANDPASS FILTER WITH NO THIRD ORDER RESPONSE

CROSS REFERENCE TO RELATED APPLICATIONS

The present application is related to U.S. patent application Ser. No. 12/983,351 entitled MICROWAVE FILTER which was filed on Jan. 3, 2011, is assigned to the assignee of the present application and is incorporated by reference herein in its entirety. The present application is related to U.S. patent application Ser. No. 12/983,383 entitled METHODS AND APPARATUS FOR RECEIVING RADIO FREQUENCY SIGNALS, now U.S. Pat. No. 8,478,223, which was filed on Jan. 3, 2011, is assigned to the assignee of the present application and is incorporated by reference herein in its entirety.

BACKGROUND OF THE INVENTION

The present invention relates in general to microwave signal processing circuitry and, more particularly, to a microwave filter illustrated in a bandpass filter implemented in microstrip circuitry for which it is initially being used.

Bandpass filters are designed to pass a desired range of frequencies and to reject others above and below the desired range of frequencies. A common characteristic of bandpass filters is that they also pass higher frequencies, usually at the third and higher odd multiples of the desired range of frequencies. When the passage of the higher frequencies is not desirable, additional filtering, such as a low-pass filter or a band-reject filter, is required to suppress the higher frequency responses of the bandpass filter. Such additional filtering requires the use of additional printed circuit board space, and the longer lengths traversed by the radio frequency signal causes additional losses.

SUMMARY OF THE INVENTION

A bandpass filter is tuned and designed to allow a passband, a range of frequencies, to pass with low loss while suppressing frequencies above and below the passed range of frequencies. Circuitry is included into the existing structure of the bandpass filter so that higher frequencies can also be suppressed to thereby reject a band of frequencies at a selected odd multiple of the passed frequency range.

In accordance with the teachings of the present application, a microwave filter comprises a plurality of vertical microstrip elements placed parallel to one another. The plurality of vertical microstrip elements have upper ends that are open circuited and lower ends that are connected to ground potential. At least one horizontal microstrip element connects each of the plurality of vertical microstrip elements to one another, and a spurline is formed in the at least one horizontal microstrip element. In this way, the filter passes a band of frequencies defined by the vertical microstrip elements, connection points of the at least one horizontal microstrip element, the location of a signal input point of the filter and the location of a signal exit point of the filter, and the filter blocks a band of frequencies defined by the spurline formed in the at least one horizontal microstrip.

The plurality of vertical microstrip elements (P) may be greater than two and the at least one horizontal microstrip element then comprises a plurality equal to the plurality of vertical microstrip elements minus one (P−1).

The frequencies of the blocked band of frequencies is substantially equal to an odd multiple of the frequencies of the passed band of frequencies. For example, the frequencies of the blocked band of frequencies may be substantially equal to three times the frequencies of the passed band of frequencies.

BRIEF DESCRIPTION OF THE SEVERAL VIEWS OF THE DRAWINGS

The following detailed description of the preferred embodiments of various embodiments of the present invention can be best understood when read in conjunction with the following drawings, where like structure is indicated with like reference numerals, and in which.

DETAILED DESCRIPTION OF THE INVENTION

In the following detailed description of the illustrated embodiments, reference is made to the accompanying drawings that form a part hereof, and in which is shown by way of illustration, and not by way of limitation, specific embodiments in which the invention may be practiced. It is to be understood that other embodiments may be utilized and that changes may be made without departing from the spirit and scope of various embodiments of the present invention. The microwave filter of the present application is described with reference to microstrip technology for which it is initially being used.

Figure 1:
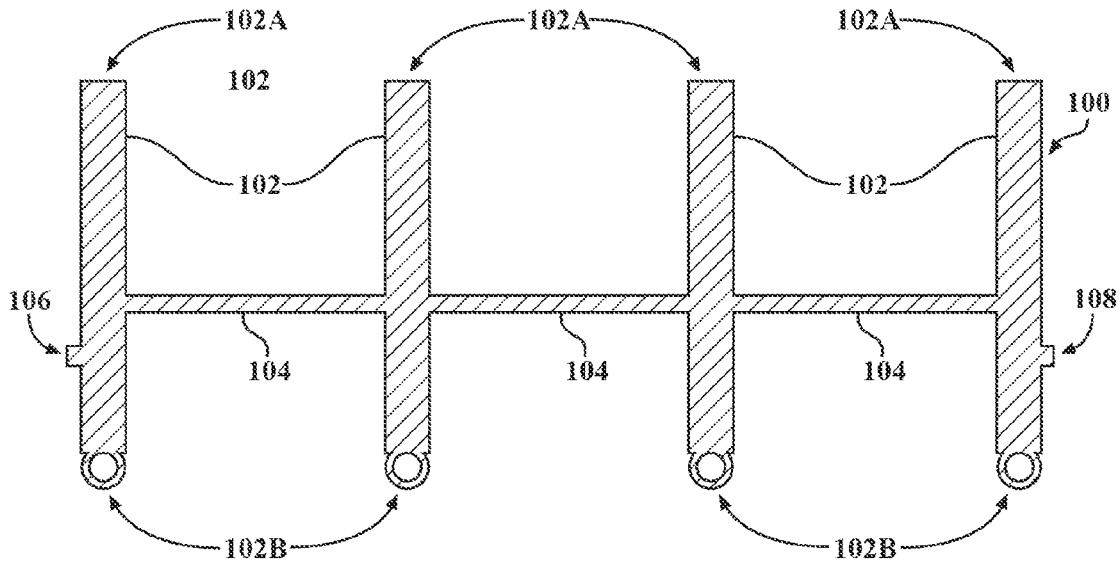
FIG. 1 PRIOR ART
FIG. 1 shows a conventional design for a microstrip bandpass filter.

Reference is made to FIG. 1 which shows a conventional design for a microstrip bandpass filter 100 which comprises a plurality of vertical microstrip elements 102 placed parallel to one another and connected to one another by horizontal microstrip elements 104. The upper ends 102A of the elements 102 are open while the lower ends 102B of the elements 102 are connected to ground. For example, the lower ends 102B may be connected to a ground plane by vias represented by the round holes at the lower ends 102B of the vertical elements 102.

The filter 100 is tuned by selecting the length of each of the elements 102, the points at which each horizontal microstrip element 104 is attached to each vertical element 102 and the lengths of the horizontal microstrip elements 104, as well as the point of signal entry 106 and the point of signal exit 108 on each end of the filter 100. The frequency response of one configuration of a filter as illustrated in FIG. 1 is shown in FIG. 2 where the filter defines a passband frequency range in the vicinity of 5 GHz.

Figure 2:
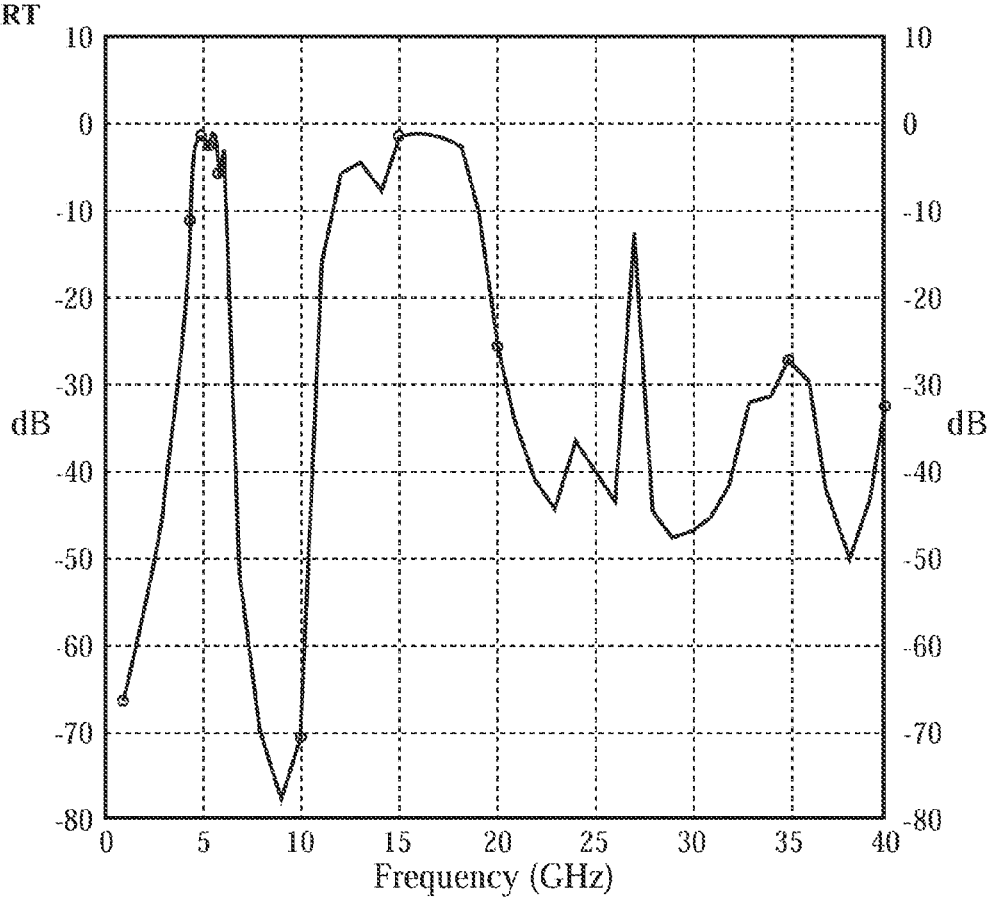
FIG. 2 PRIOR ART
FIG. 2 shows a characteristic frequency response curve of a bandpass filter, such as the bandpass filter of FIG. 1.

As shown in FIG. 2, the passband frequency range around 5 GHz is passed while lower and higher frequencies are rejected. As also shown in FIG. 2, frequencies in the range of three times the desired frequency range, around 15 GHz are also passed, and this is a general property of almost all passband filter designs. The selectivity of the filter 100 can be decreased by the use of fewer elements and can be increased by the use of more elements, but the basic features of the frequency response would be similar. If the frequency band at around three times the desired frequency range needs to be suppressed by the nature of the circuit design in which the filter operates, additional filter circuitry would be needed to suppress these higher frequencies. The need for additional filter circuitry is generally true of bandpass filter designs, including the exemplary filter 100 and filters with gap-coupled elements.

Figure 3:
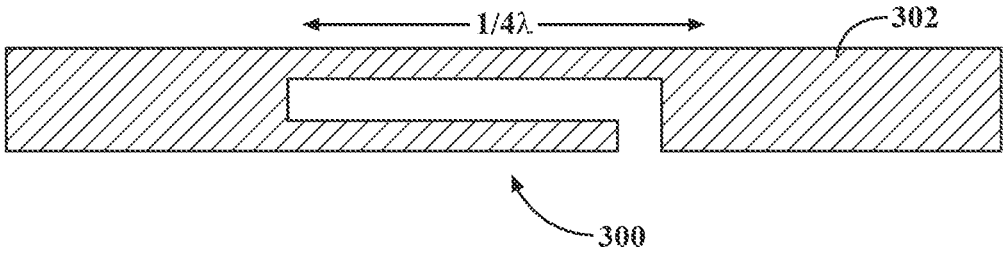
FIG. 3 PRIOR ART
FIG. 3 shows a conventional design for a notch filter where a spurline is formed in a section of microstrip circuit.
Figure 4:
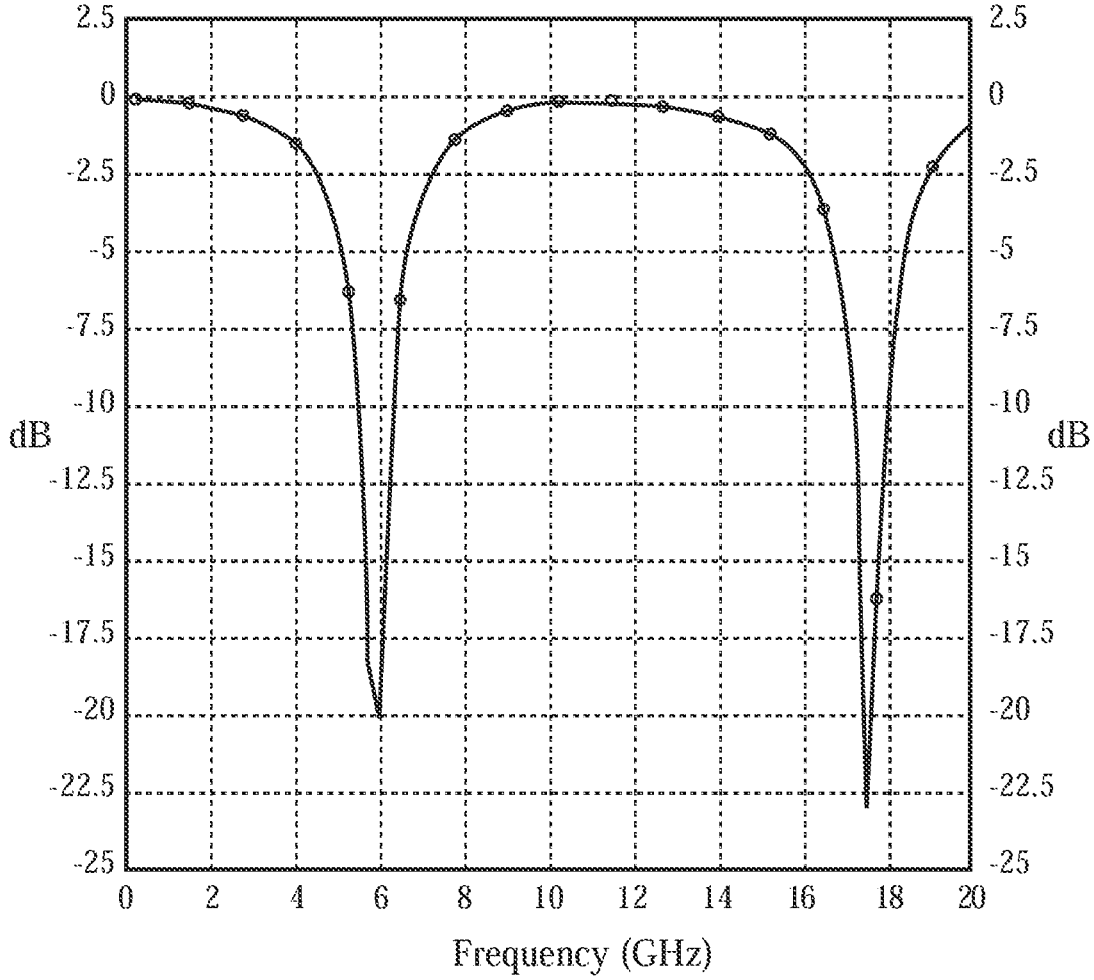
FIG. 4 PRIOR ART
FIG. 4 shows a characteristic frequency response curve of a notch filter such as the notch filter of FIG. 3 wherein odd harmonics of the desired notch frequency are also rejected.

It is also known to use a "spurline" in a microstrip circuit to create a notch filter. A spurline consists of a cut in the microstrip circuit shaped like an L having one end, the short leg of the L, open to one side of the microstrip circuit and the rest of the spurline cut, the long leg of the L, entirely contained within the microstrip circuit. With reference to FIG. 3, if a spurline 300 is formed in a section of microstrip circuit 302, signals of a specific frequency and frequencies around the specific frequency will be rejected to define the notch. With a spurline having a nominal length of ¼λ, microwave energy at the desired notch frequency λ fed into the microstrip circuit 302 at the left is rejected and does not exit from the right end of the microstrip circuit 302. FIG. 4 shows a characteristic frequency response curve of the notch filter wherein odd harmonics of the desired notch frequency are also rejected.

Figure 5:
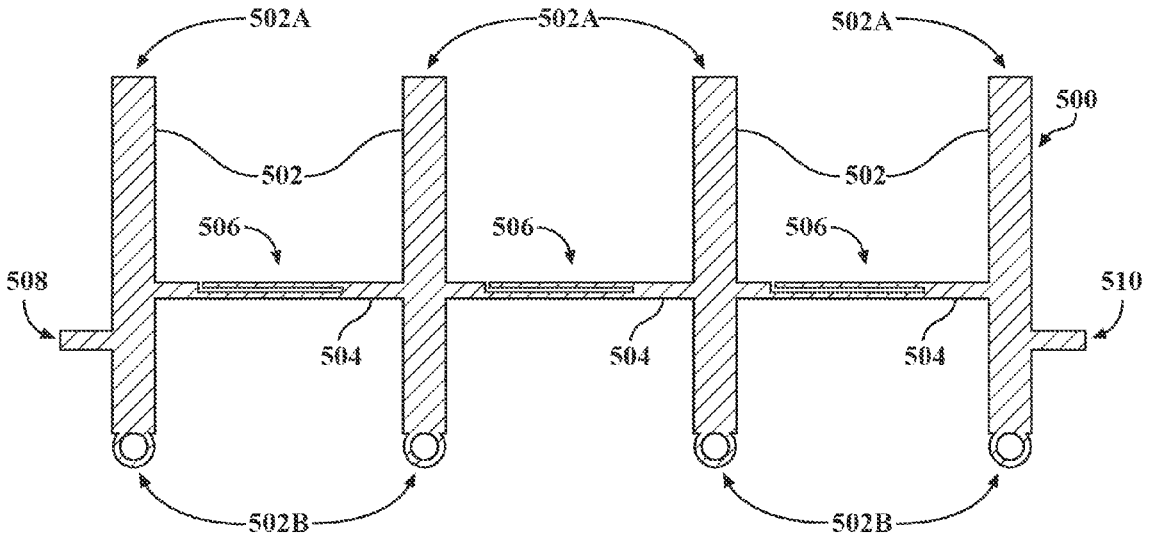
FIG. 5 shows a compact embodiment of a bandpass filter in accordance with the teachings of the present application wherein no third order response is created.

In accordance with the teachings of the present application, by forming at least one spurline in at least one of the horizontal microstrip elements 104 of the bandpass filter 100 of FIG. 1, a compact embodiment of a bandpass filter is created with at least one of the odd higher-order responses being reduced or at least one of the odd higher-order responses being substantially eliminated. An exemplary embodiment is shown in FIG. 5 wherein a bandpass filter 500 comprises a plurality of vertical microstrip elements 502 placed parallel to one another and connected to one another by horizontal microstrip elements 504 wherein each of the horizontal microstrip elements 502 includes a single spurline 506. By including spurlines in each of the horizontal microstrip elements 504, the third order response is maximally suppressed. Additional spurlines may be formed in one or more of the horizontal microstrip elements 504 to further reduce a given odd higher-order response or to at least partially suppress one or more additional odd higher-order responses.

In the illustrated embodiment of FIG. 5, the upper ends 502A of the elements 502 are open and the lower ends 502B of the elements 502 are connected to ground. For example, the lower ends 502B may be connected to a ground plane (not shown) located beneath the elements 502 using vias represented by the round openings at the lower ends 502B of the vertical elements 502. It is noted that the teachings of the present application are equally applicable to similar filter designs that have vertical microstrip elements that are open at both ends or grounded at both ends. While such filters would provide different filtering characteristics, use of the teachings of the present application would still reduce or eliminate a third or higher-order odd harmonic response if required for a given application.

The bandpass filter 500 is tuned by selecting the length of each of the elements 502, the points at which each horizontal microstrip element 504 is attached to each vertical element 502 and the lengths of the horizontal microstrip elements 504, as well as the point of signal entry 508 and the point of signal exit 510 on each end of the filter 500. The band of frequencies, i.e., the suppressed higher-order odd response, that is rejected is tuned by appropriately sizing and shaping the spurlines 506. As an example, the spurlines 506 may be sized and shaped to block the third harmonic or third order response of the filter 500 so that the lengths of the spurlines 506 are set to be about ¼λ where λ is the wavelength of the third harmonic of the center frequency of the passband.

Figure 6:
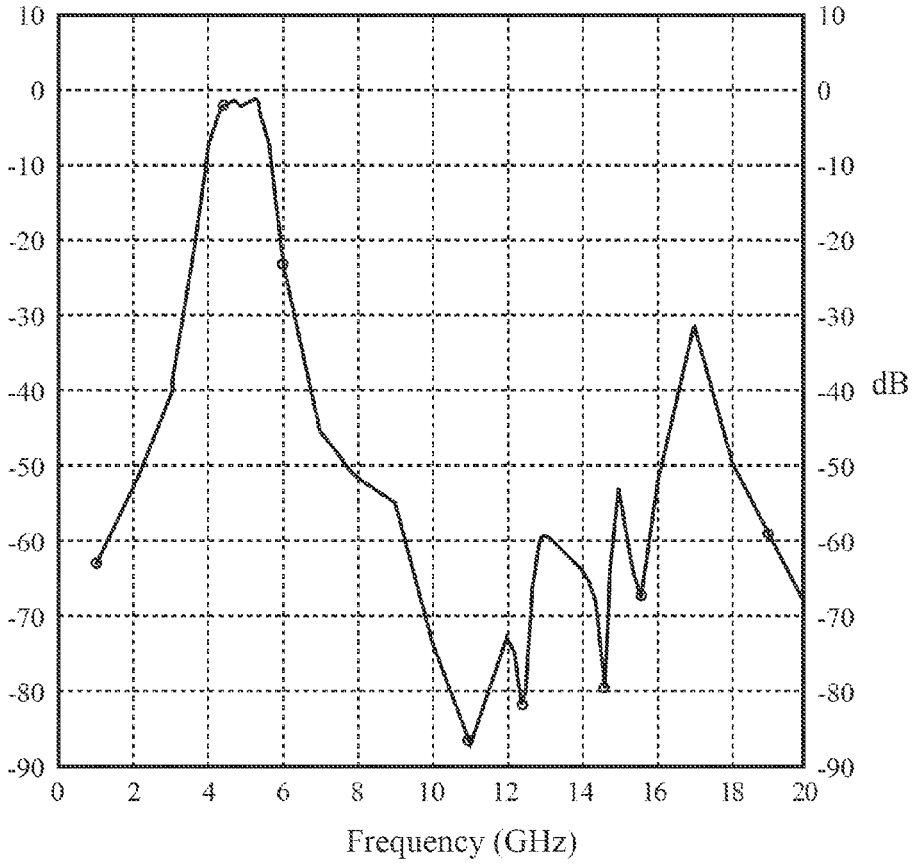
FIG. 6 shows a frequency response of the passband filter of FIG. 5 wherein the frequency range around 5 GHz is passed while lower and higher frequencies including frequencies in the range of three times the desired frequency range, i.e., around 15 Ghz, are rejected.

As shown in FIG. 6, a passband frequency range around 5 GHz is passed while lower and higher frequencies are rejected. Different from the frequency response of the filter 100 as shown in FIG. 2, frequencies in the range of three times the desired frequency range, i.e., around 15 Ghz, are rejected. The selectivity of the filter 500 can be decreased by the use of fewer elements and can be increased by the use of more elements, but the basic features of the frequency response would be similar. Thus, using the teachings of the present application, the requirement that a desired range of frequencies is passed by a filter, while at the same time the frequency range at three times or a higher-order odd multiple of the desired frequency range is not passed by the filter is accomplished without the need of adding preceding or following filter circuitry, and without increasing the physical area occupied by the filter.

Having thus described the invention of the present application in detail and by reference to preferred embodiments thereof, it will be apparent that modifications and variations are possible without departing from the scope of the invention defined in the appended claims.

What is claimed is:

1. A microwave filter, comprising:

a plurality of vertical microstrip elements placed parallel to one another, said plurality of vertical microstrip elements having upper ends and lower ends;

at least one horizontal microstrip element connecting each of said plurality of vertical microstrip elements to one another; and at least one spurline formed in at least one of said at least one horizontal microstrip element;

wherein said filter microwave passes a passband of frequencies defined by said plurality of vertical microstrip elements, connection points of said at least one horizontal microstrip element, a signal input point of said filter and a signal exit point of said microwave filter, said plurality of vertical microstrip elements suppressing frequencies above and below said passband to define said passband between said frequencies suppressed by said plurality of vertical microstrip elements, and said microwave filter blocks third harmonic frequencies of said passband, said third harmonic frequencies of said passband being blocked only by said at least one spurline formed in at least one of said at least one horizontal microstrip.

2. A microwave filter as recited in claim 1 wherein said upper ends of said plurality of vertical microstrip elements are open circuited and said lower ends of said plurality of vertical microstrip elements are connected to ground potential.

3. A microwave filter as recited in claim 2 wherein said plurality of vertical microstrip elements (P) is greater than two and said at least one horizontal microstrip element comprises a plurality equal to the plurality of vertical microstrip elements minus one (P−1) and one of at least one spurline is formed in each of said (P−1) horizontal microstrip elements.

* * * * *